US008536961B2

(12) United States Patent
Takaya et al.

(10) Patent No.: US 8,536,961 B2
(45) Date of Patent: Sep. 17, 2013

(54) REVERSIBLE ELECTROMAGNETIC CONTACTOR

(75) Inventors: Kouetsu Takaya, Kounosu (JP); Koji Okubo, Kounosu (JP); Yasuhiro Naka, Kounosu (JP); Kenji Suzuki, Kounosu (JP)

(73) Assignee: Fuji Electric Fa Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 13/508,242

(22) PCT Filed: Sep. 13, 2010

(86) PCT No.: PCT/JP2010/005586

§ 371 (c)(1), (2), (4) Date: Jun. 12, 2012

(87) PCT Pub. No.: WO2011/092763

PCT Pub. Date: Aug. 4, 2011

(65) Prior Publication Data

US 2012/0280771 A1 Nov. 8, 2012

(30) Foreign Application Priority Data

Jan. 29, 2010 (JP) ..... 2010-018288

(51) Int. Cl.
*H01H 73/12* (2006.01)

(52) U.S. Cl.
USPC ..... 335/17; 335/202

(58) Field of Classification Search
USPC ..... 335/2, 202, 17; 200/50.32, 50.33
See application file for complete search history.

(56) References Cited

U.S. PATENT DOCUMENTS

| | | | | |
|---|---|---|---|---|
| 3,815,063 | A * | 6/1974 | Grunert et al. | 335/160 |
| 4,045,628 | A * | 8/1977 | Schienda | 200/50.33 |
| 4,513,181 | A * | 4/1985 | Boysen et al. | 200/50.33 |
| 4,876,418 | A | 10/1989 | Fournier | |
| 5,164,694 | A | 11/1992 | DeVault et al. | |
| 8,378,767 | B2 * | 2/2013 | Okubo et al. | 335/132 |
| 8,466,759 | B2 * | 6/2013 | Takaya et al. | 335/17 |

FOREIGN PATENT DOCUMENTS

| | | | |
|---|---|---|---|
| JP | H03-266325 | A | 11/1991 |
| JP | H04-99317 | U | 8/1992 |
| JP | H06-076719 | A | 3/1994 |

* cited by examiner

*Primary Examiner* — Bernard Rojas
(74) *Attorney, Agent, or Firm* — Manabu Kanesaka

(57) ABSTRACT

A reversible unit (20) has a pair of interlock plates (21, 22) detachably connected to operation indication pieces (4*a*, 4*b*) of a pair of electromagnetic contactors (1*a*, 1*b*) and moving in the same direction as the moving direction of the operation indication pieces, a lock piece (23) connecting with the pair of interlock plates (21, 22), a first normally-closed contact (24), and a second normally-closed contact (25). In a closing operation of one of the electromagnetic contactors (1*a*), the lock piece (23) moves one of the interlock plates (21) and prohibits the movement of the other interlock plate (22). The first normally-closed contact (24) is connected in series in a power supply circuit to an exciting coil (6*b*) of the other electromagnetic contactor (1*b*). One of the interlock plates (21) has a first opening operation engagement portion (34) releasing the first normally-closed contact (24) when the interlock plate (21) moves.

5 Claims, 13 Drawing Sheets

REVERSIBLE ELECTROMAGNETIC CONTACTOR

RELATED APPLICATIONS

The present application is National Phase of International Application No. PCT/JP2010/005586 filed Sept. 13, 2010, and claims priority from Japanese Application No. 2010-018288, filed Jan. 29, 2010.

TECHNICAL FIELD

The present invention relates to a reversible electromagnetic contactor that mechanically and electrically interlocks simultaneous closing of two electromagnetic contactors of two electromagnetic contactors disposed adjacently, by using a reversible unit.

BACKGROUND ART

For example, a device in which a reversible unit is mounted across two adjacently disposed electromagnetic contactors and the reversible unit is mechanically interlocked so as to prevent the two electromagnetic contactors from being closed simultaneously (simultaneous ON operation) is known as a reversible electromagnetic contactor that is connected to the control circuit of an induction motor and performs direct-reverse operation control of the induction motor (for example, Patent Document 1).

FIGS. 11 and 12 illustrate the conventional reversible electromagnetic contactor similar to that described in Patent Document 1. In an electromagnetic contactor 1*a* shown in FIG. 11, a fixed iron core (not shown in the figure), a movable iron core (not shown in the figure) disposed opposite the fixed iron core, and a coil (not shown in the figure) disposed on the outer circumference of the main leg of the fixed iron core are housed in the lower portion inside a case 5, and when the coil is energized and the movable iron core is attracted to the fixed iron core, a movable contact (not shown in the figure) fixed to a movable contact support 4 and a fixed contact are opened and closed. A display window 3*a* is formed in an arc-extinguishing cover 2*a* provided on top of the electromagnetic contactor 1*a*, and an operation indication piece 4*a* fixed to the movable contact support 4 protrudes into the display window 3*a*.

Another electromagnetic contactor 1*b*, which is disposed adjacently to the electromagnetic contactor 1*a*, has the same structure, and when the coil thereof is energized and the movable iron core is attracted to the fixed iron core, a movable contact fixed to a movable contact support 4 and a fixed contact are opened and closed. A display window 3*b* is formed in an arc-extinguishing cover 2*b* provided on top of the electromagnetic contactor, and an operation indication piece 4*b* fixed to the movable contact support (not shown in the figure) protrudes into the display window 3*b*.

As shown in FIG. 11, the reversible unit 6 comprises a unit bottom plate 6*a* connected to arc-extinguishing covers 2*a*, 2*b* in a state of being laid across the two electromagnetic contactors 1*a*, 1*b* and a unit cover 6*b* that is engaged by the circumferential edge thereof with the circumferential edge of the unit bottom plate 6*a*. A first interlock plate 6*c*, a second interlock plate 6*d*, and a lock piece 6*e* constituting a lock mechanism are rotationally connected to each other in the inner space formed by these unit bottom plate 6*a* and the unit cover 6*b*. Tubular connection bridges 6*f*, 6*g* are formed at the rear surface of the first interlock plate 6*c* and the second interlock plate 6*d* at the end side thereof and protrude to the outside through openings 6*h*, 6*i* formed in the bottom plate 6*a*.

When the connection bridges 6*f*, 6*g* of the reversible unit 6 are connected in the respective fitting state thereof to the head portions of the operation indicating pieces 4*a*, 4*b* of the two electromagnetic contactors 1*a*, 1*b* in a state in which the unit bottom plate 6*a* abuts on the air-extinguishing covers 2*a*, 2*b*, the lock piece 6*e* causes the rotation of either of the first interlock plate 6*c* and the second interlock plate 6*d*, restricts the rotation of the other of the interlock plates, and enables the movement of only one of the operation indication pieces 4*a*, 4*b*, thereby performing mechanical interlock such that makes it impossible to close the two electromagnetic contactors 1*a*, 1*b* simultaneously.

FIG. 13 shows an example of a control circuit for an induction motor provided with an electrical interlock in addition to the mechanical interlock performed by the reversible unit 6.

In FIG. 13, a first switch-on push-button 11 and a second switch-on push-button 12 are connected in parallel to a push-button 10, and these first and second switch-on push-buttons 11, 12 and auxiliary contacts 13, 14 of normally-closed contacts (contacts (b)) of the two electromagnetic contactors 1*a*, 1*b* are connected in series.

Further, a coil $C_{1a}$ and a coil $C_{1b}$ of the two electromagnetic contactors 1*a*, 1*b* and the auxiliary contacts 13, 14 of contacts (b) are connected in series, the coil $C_{1a}$ is connected to the auxiliary contact 13 of the contact (b), the coil $C_{1b}$ is connected to the auxiliary contact 14 of the contact (b), and the electrical interlock is performed such that when an exciting circuit of either of the coil $C_{1a}$ and the coil $C_{1b}$ is closed, the exciting circuit of the other of the coil $C_{1a}$ and the coil $C_{1b}$ is open.

The first switch-on push-button 11 and the second switch-on push-button 12 are provided with respective normally-open contacts 11*a*, 12*a* and normally-closed contacts 11*b*, 12*b* and have the configuration such that the normally-open contact 11*a* is mechanically interlocked with the normally-closed contact 11*b*, and the normally-open contact 12*a* is mechanically interlocked with the normally-closed contact 12*b*.

Patent Document 1: Japanese Patent Application Publication No. H3-266325.

As shown in FIG. 13, the normally-closed contacts (contacts (b)) are necessary to ensure electrical interlock. Therefore, in the case of the two electromagnetic contactors 1*a*, 1*b* which incorporate only one pole of the auxiliary contacts of the normally-open contacts (contacts (a)), an additional auxiliary contact unit should be connected because the normally-closed contacts (contacts (b)) are necessary. When the auxiliary contact unit is thus connected to ensure electrical interlock, outer dimensions are increased and problems are associated in terms of size reduction. In addition, the device cost can be increased since the auxiliary contact unit is used.

DISCLOSURE OF THE INVENTION

Meanwhile, in the case of the two electromagnetic contactors which incorporate only one pole of the auxiliary contacts of the normally-closed contacts (contacts (b)), since the auxiliary contacts of the incorporated normally-closed contacts (contacts (b)) are used for the electrical interlock, when another additional circuit such as an auto-holding circuit and a signal circuit is wished to be connected, an auxiliary contact unit is required, and the problems are associated with the reduction in size due to the increase in the outer dimensions and with the increase in the device cost caused by the use of the auxiliary contact unit.

Accordingly, the present invention has been created to resolve the abovementioned unsolved problems associated with the related art, and it is an object of the present invention to provide a reversible electromagnetic contactor that makes it possible to connect an additional circuit, without using an auxiliary contact incorporated in the electromagnetic contactor, when performing mechanical and electrical interlock in order to prevent two electromagnetic contactors from being closed simultaneously, and also enables size and cost reduction.

In order to attain the abovementioned object, the present invention in one embodiment thereof provides a reversible electromagnetic contactor in which a pair of electromagnetic contactors is disposed adjacently so that respective operation indication pieces protruding on upper surfaces move in the same direction in a closing operation and a reversible unit is mounted across the upper surfaces of the pair of electromagnetic contactors, wherein the reversible unit comprises a pair of interlock plates detachably connected to the respective operation indication pieces of the pair of electromagnetic contactors and moving in the same direction as a moving direction of the operation indication pieces; a lock piece which connects the pair of interlock plates, a first normally-closed contact, a second normally-closed contact, and a unit case that accommodates the pair of interlock plates, the lock piece, and the first and second normally-closed contacts and that is mounted across the upper surfaces of the pair of electromagnetic contactors. In a closing operation of one of the electromagnetic contactors, the lock piece rotates in a first direction as one of the interlock plates moves to prevent the other of the interlock plates from moving, and maintains a release operation of the other of the electromagnetic contactors. In a closing operation of the other of the electromagnetic contactors, the lock piece rotates in a second direction, which is different from the first direction, as the other of the interlock plates moves to prevent the one of the interlock plates from moving, and maintains a release operation of the one of the electromagnetic contactors. The first normally-closed contact is connected in series in a power supply circuit to an exciting coil of the other of the electromagnetic contactors, and the one of the interlock plates comprises a first opening operation engagement portion that performs an operation of opening the first normally-closed contact when the one of the interlock plates moves. The second normally-closed contact is connected in series in a power supply circuit to an exciting coil of the one of the electromagnetic contactors, and the other of the interlock plates comprises a second opening operation engagement portion that performs an operation of opening the second normally-closed contact when the other of the interlock plates moves.

With the reversible electromagnetic contactor according to this embodiment, in the closing operation of one of the electromagnetic contactors, the lock piece rotates in the first direction as one of the interlock plates moves to prevent the other of the interlock plates from moving, and maintains the release operation of the other of the electromagnetic contactor. Further, in the closing operation of the other of the electromagnetic contactors, the lock piece rotates in the second direction, which is different from the first direction, as the other of the interlock plates moves to prevent the one of the interlock plates from moving, and maintains a release operation of the one of the electromagnetic contactors. The present invention thus enables mechanical interlock of simultaneous closing of the two electromagnetic contactors.

Further, in the closing operation of the one of the electromagnetic contactors, the first opening operation engagement portion provided at the one of the interlock plates performs the operation of opening the first normally-closed contact that is connected in series in a power supply circuit to an exciting coil of the other of the electromagnetic contactors and cuts off power supply to the exciting coil of the other of the electromagnetic contactors. In the closing operation of the other of the electromagnetic contactors, the second opening operation engagement portion provided at the other of the interlock plates performs the operation of opening the second normally-closed contact that is connected in series in a power supply circuit to an exciting coil of the one of the electromagnetic contactors and cuts off power supply to the exciting coil of the one of the electromagnetic contactors. In this manner, the reversible electromagnetic contactor according to one embodiment also enables electrical interlock to prevent simultaneous closing of the two electromagnetic contactors.

The first opening operation engagement portion and the second opening operation engagement portion provided at the pair of interlock plates that are constituent members of the mechanical interlock serve as members that directly perform the operation of opening the first normally-closed contact and the second normally-closed contact. Therefore, the electrical interlock can be simplified.

Further, the normally-closed contacts are necessary to ensure the electrical interlock, but in the reversible electromagnetic contactor according to one embodiment, the first normally closed contact and the second normally closed contact are provided inside the reversible unit. Therefore, it is not necessary to connect additional auxiliary contact units to the auxiliary contacts of the normally-open contacts incorporated by one pole thereof in the two electromagnetic contactors. Since the connection of the auxiliary contact units is thus unnecessary, the external dimensions of the reversible electromagnetic contactor are not increased and expenses on the auxiliary contact unit are unnecessary. Therefore, the contactor can be reduced in size and cost.

In the reversible electromagnetic contactor according to one embodiment, the first normally-closed contact comprises a first fixed contact and a first movable contact including a spring member, and is disposed along a moving direction of the one of the interlock plates. When the one of the interlock plates moves, the first opening operation engagement portion moving toward the first normally-closed contact elastically deforms the first movable contact in a direction withdrawing from the first fixed contact to establish an open state.

With such a reversible electromagnetic contactor according to this embodiment, a simple structure is used in which the first opening operation engagement portion provided at one of the interlock plates elastically deforms the first movable contact including a spring member and performs the operation of opening the first normally-closed contact. Therefore, the electrical interlock can be further simplified.

Further in the reversible electromagnetic contactor according to one embodiment, the first opening operation engagement portion is a protrusion engageable with the first movable contact and formed integrally with the one of the interlock plates positioned at the first normally-closed contact side.

With the reversible electromagnetic contactor according to this embodiment, the first movable contact provided at the one of the interlock plates is a zone having a protruding shape. Therefore, the production cost of the one of the interlock plates can be reduced.

In the reversible electromagnetic contactor according to one embodiment, the second normally-closed contact comprises a second fixed contact and a second movable contact including a spring member, and is disposed along a moving direction of the other of the interlock plates. When the other of the interlock plates moves, the second opening operation engagement portion moving toward the second normally-closed contact elastically deforms the second movable contact in a direction withdrawing from the first fixed contact to establish an open state.

With such a reversible electromagnetic contactor according to this embodiment, a simple structure is used in which the second opening operation engagement portion provided at the other of the interlock plates elastically deforms the second movable contact constituted by a spring member and performs the operation of opening the second normally-closed contact. Therefore, the electrical interlock can be further simplified.

Further, in the reversible electromagnetic contactor according to one embodiment, the second opening operation engagement portion is a protrusion engageable with the second movable contact and formed integrally with the other of the interlock plates positioned at the second normally-closed contact side.

With the reversible electromagnetic contactor according to this embodiment, the second movable contact provided at the other of the interlock plates is a zone having a protruding shape. Therefore, the production cost of the other of the interlock plates can be reduced.

Furthermore, in the reversible electromagnetic contactor according to one embodiment, unit connection terminals for connection to the first normally-closed contact and the second-normally closed contact are provided at an end portion of the reversible unit.

With the reversible electromagnetic contactor according to this embodiment, the operation of connecting the first normally-closed contact and the second normally-closed contact of the reversible unit to the pair of electromagnetic contactors can be facilitated.

With the reversible electromagnetic contactor in accordance with the present invention, mechanical and electrical interlock can be performed such that two electromagnetic contactors cannot be closed simultaneously. Further, the first opening operation engagement portion and the second opening operation engagement portion provided at the pair of interlock plates that are constituent members of the mechanical interlock serve as members that directly perform the operation of opening the first normally-closed contact and the second normally-closed contact. Therefore, the electrical interlock can be simplified. Further, the normally-closed contacts are necessary to ensure the electrical interlock, but in the present invention the first normally closed contact and the second normally closed contact are provided inside the reversible unit. Therefore, it is not necessary to connect additional auxiliary contact units having normally-closed contacts, for example, to the auxiliary contacts of the normally-open contacts incorporated by one pole thereof in the two electromagnetic contactors. Since the connection of the additional auxiliary contact units is thus unnecessary, the external dimensions of the reversible electromagnetic contactor are not increased and expenses on the auxiliary contact unit are unnecessary. Therefore, the contactor can be reduced in size and cost.

BEST MODE FOR CARRYING OUT THE INVENTION

Figure 12:
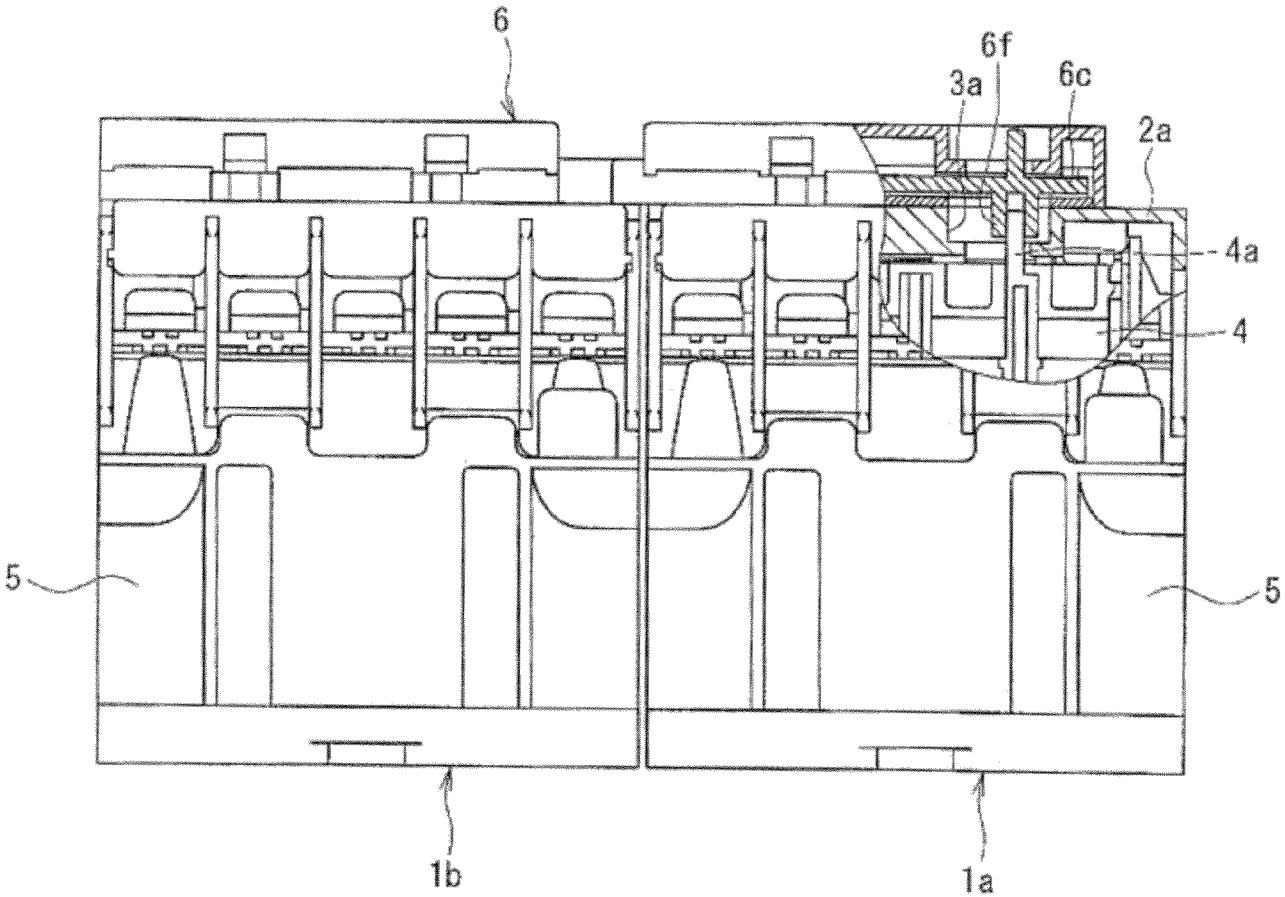
FIG. 12 Prior Art
FIG. 12 illustrates the principal components of the conventional reversible electromagnetic contactor.
Figure 13:
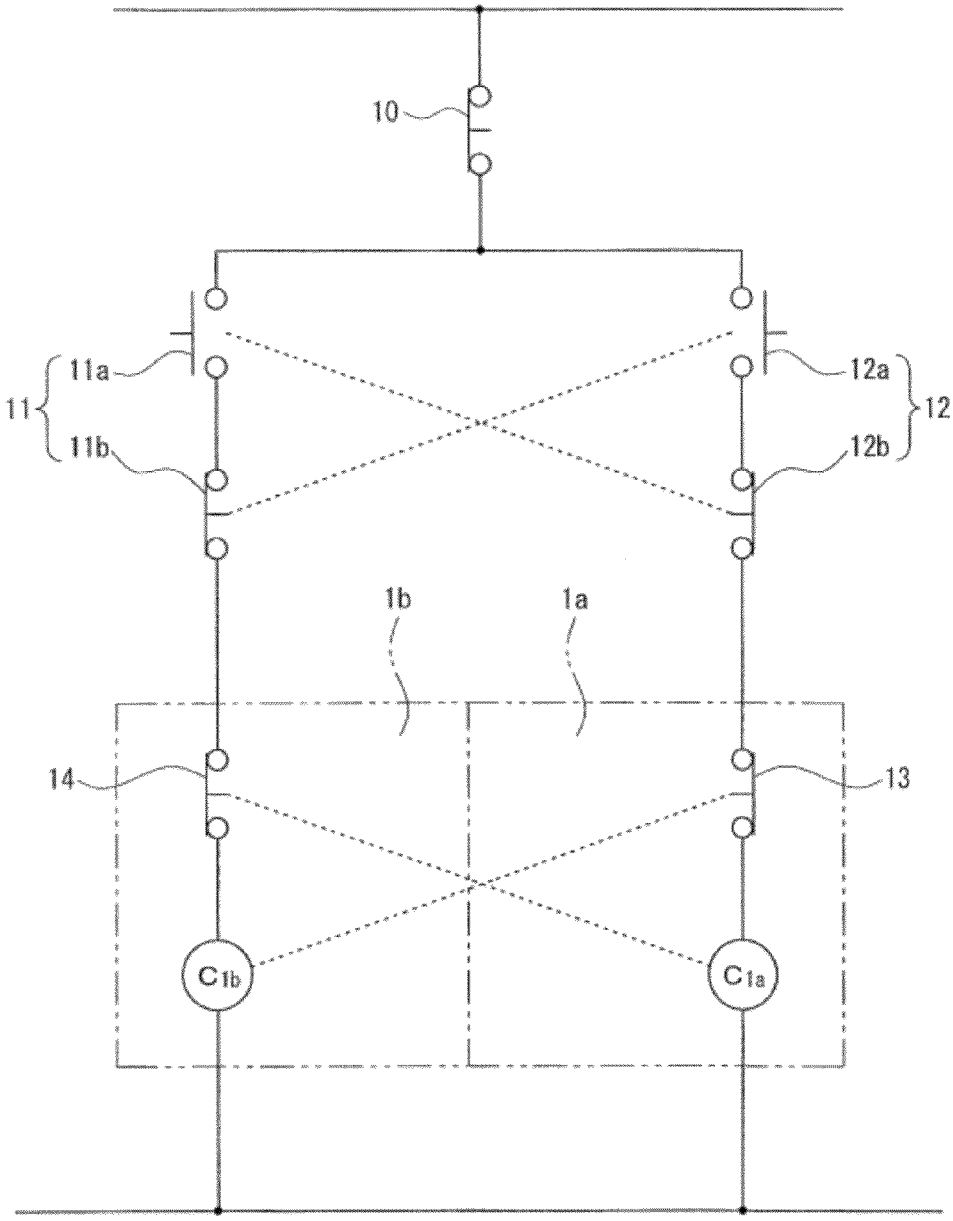
FIG. 13 Prior Art
FIG. 13 shows the control circuit of the induction motor using the conventional reversible electromagnetic contactor that is not provided with normally-closed contacts in the reversible unit.

The best mode (referred to hereinbelow as "embodiment") for carrying out the reversible electromagnetic contactor in accordance with the present invention will be explained in detail hereinbelow with reference to the appended drawings. Structural components identical to those shown in FIGS. 1 and 12 are assigned with same reference numerals and the explanation thereof is herein omitted.

Figure 1:
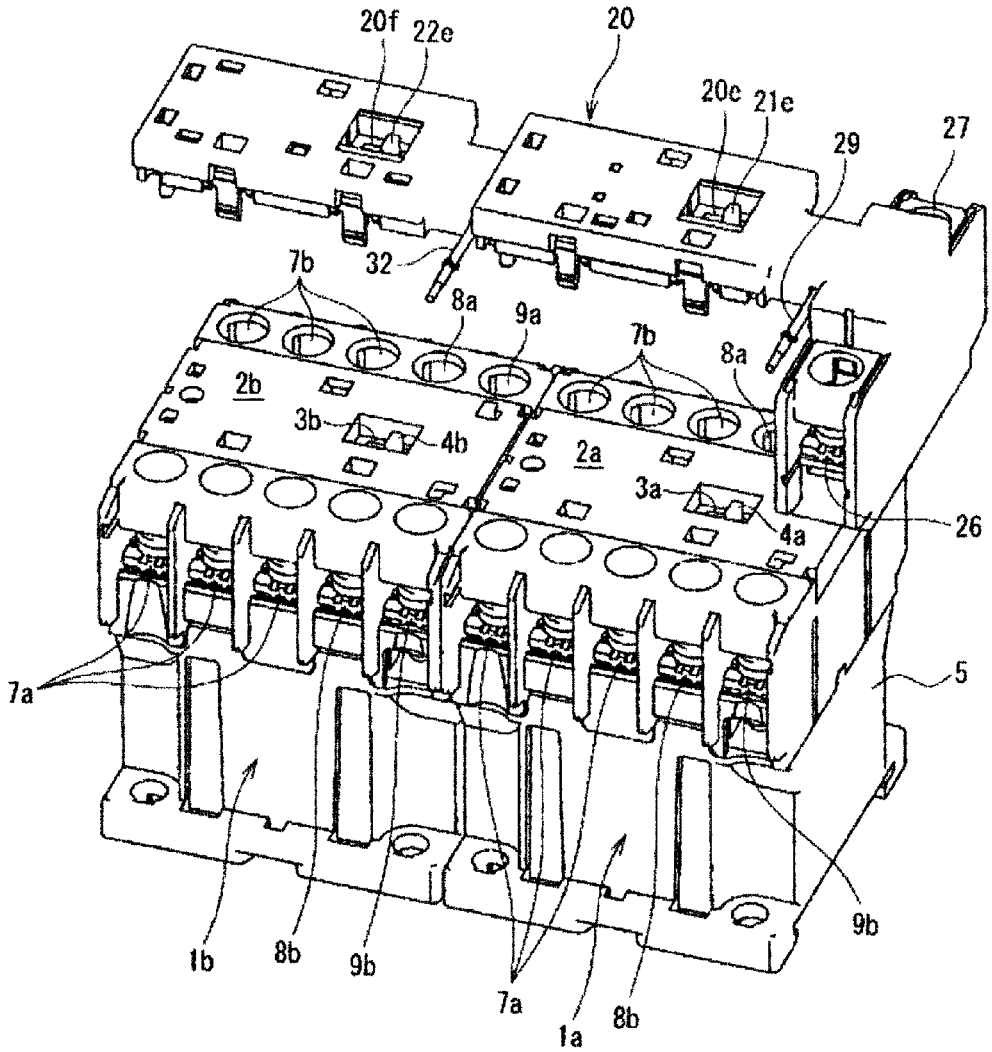
FIG. 1 is a perspective view illustrating the two electromagnetic contactors and the reversible unit constituting the present invention.
Figure 2:
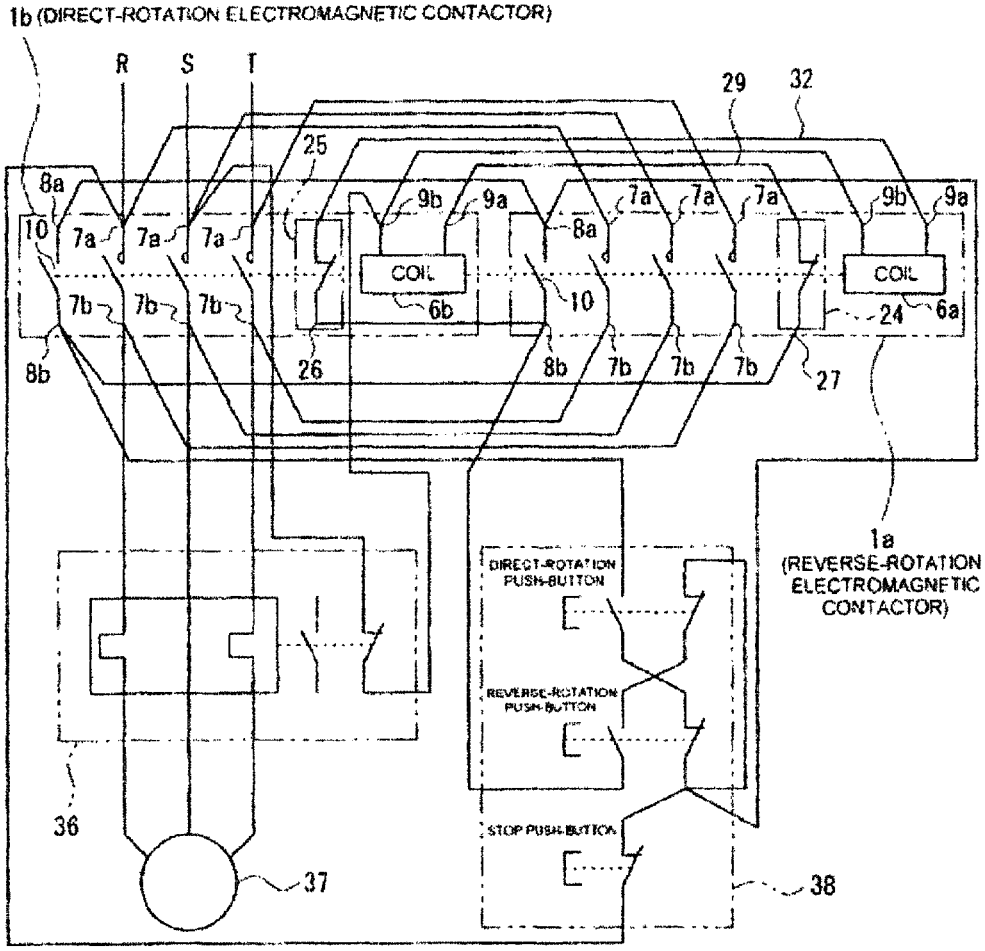
FIG. 2 shows the control circuit of the induction motor provided with the reversible electromagnetic contactor in accordance with the present invention.

FIG. 1 illustrates an embodiment of the reversible electromagnetic contactor. FIG. 2 shows an embodiment of the control circuit of an induction motor provided with the reversible electromagnetic contactor shown in FIG. 1.

As shown in FIG. 1, the reversible electromagnetic contactor according to the present embodiment has two electromagnetic contactors 1*a*, 1*b* disposed adjacently, and a reversible unit 20 is mounted across these electromagnetic contactors 1*a*, 1*b*.

In the electromagnetic contactor 1*a* shown in FIG. 1, a fixed iron core (not shown in the figure), a movable iron core (not shown in the figure) disposed opposite the fixed iron core, and a coil (reference numeral 6*a* in FIG. 2) disposed on the outer circumference of the main leg of the fixed iron core are housed in the lower portion inside a case 5, and when the coil 6*a* is energized and the movable iron core is attracted to the fixed iron core, a movable contact fixed to a movable contact support 4 and a fixed contact are opened and closed. A plurality of power-supply-side main circuit terminals 7*a* and load-side main circuit terminals 7*b*, auxiliary contact terminals 8*a*, 8*b*, and coil terminals 9*a*, 9*b* are provided on top of the case 5. A display window 3*a* is formed in an arc-extinguishing cover 2*a* provided on top of the electromagnetic contactor 1*a*, and an operation indication piece 4*a* fixed to the movable contact support 4 protrudes into the display window 3*a*.

In the electromagnetic contactor 1*a*, as shown in FIG. 2, a normally-open contact (contact (a)) is provided between the mutually opposite power-supply-side main circuit terminal 7*a* and the load-side main circuit terminal 7*b*, and an auxiliary contact 10 of the normally-open contact (contact (a)) is provided between the auxiliary contact terminals 8*a*, 8*b*. Therefore, the auxiliary contact 10 of the normally-open contact (contact (a)) is one-pole incorporated in the electromagnetic contactor 1*a*.

Another electromagnetic contactor 1*b*, which is disposed adjacently to the electromagnetic contactor 1*a*, has the same structure, and when a coil (reference numeral 6*b* in FIG. 2) is energized and the movable iron core is attracted to the fixed iron core, a movable contact fixed to a movable contact support 4 and a fixed contact are opened and closed. The auxiliary contact 10 of the normally-open contact (contact (a)) is one-pole incorporated in this electromagnetic contactor.

Figure 5:
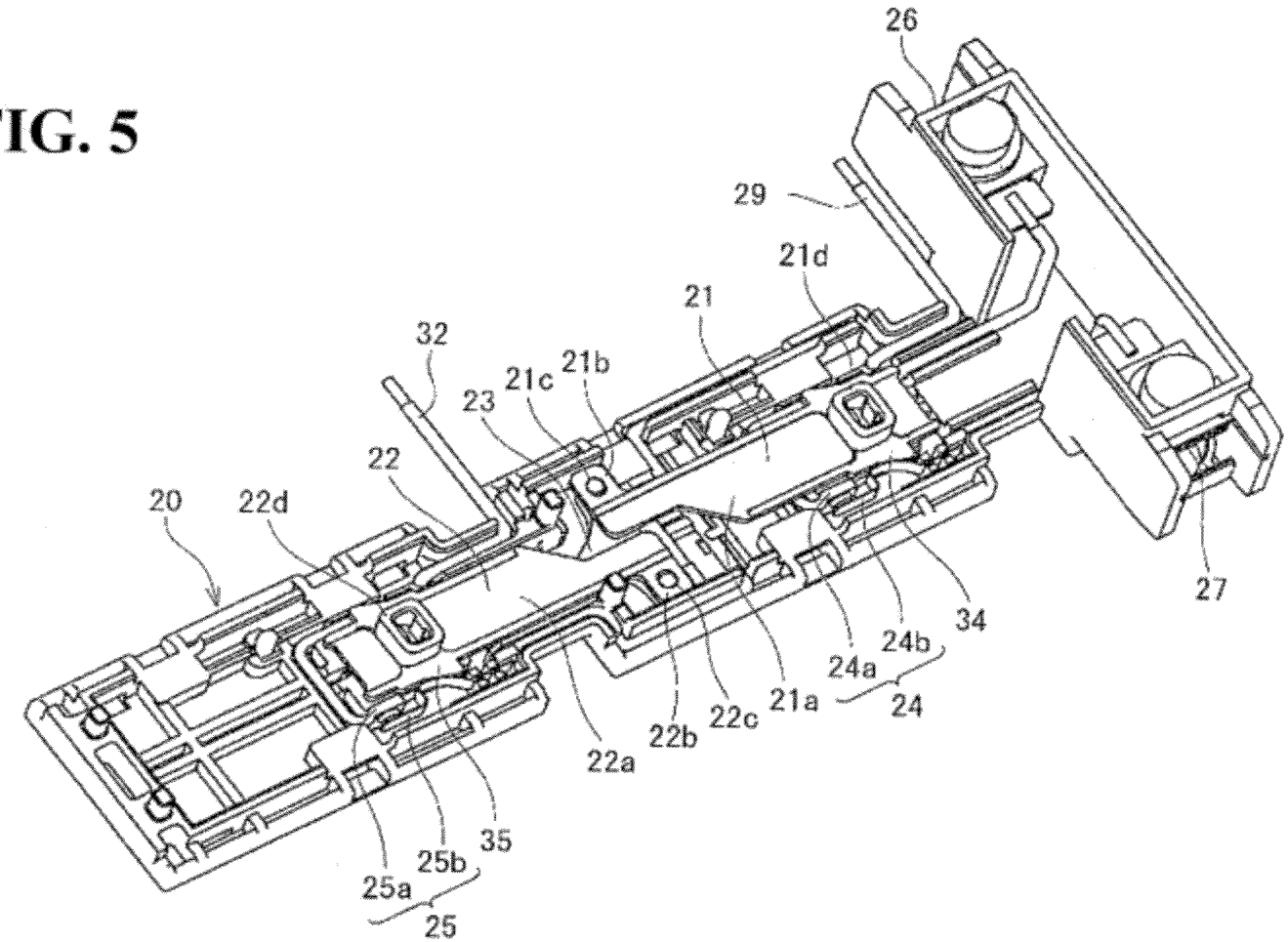
FIG. 5 shows the internal structure of the reversible unit in accordance with the present invention.

As shown in FIG. 5, the reversible unit 20 comprises a first interlock plate 21 and a second interlock plate 22, a lock piece 23 that causes only one of the first interlock plate 21 and second interlock plate 22 to move in the closing operation direction, a first normally-closed contact 24 that performs an opening operation when the first interlock plate 21 moves in the closing operation direction, and a second normally-closed contact 25 that performs an opening operation when the second interlock plate 22 moves in the closing operation direction.

Figure 3:
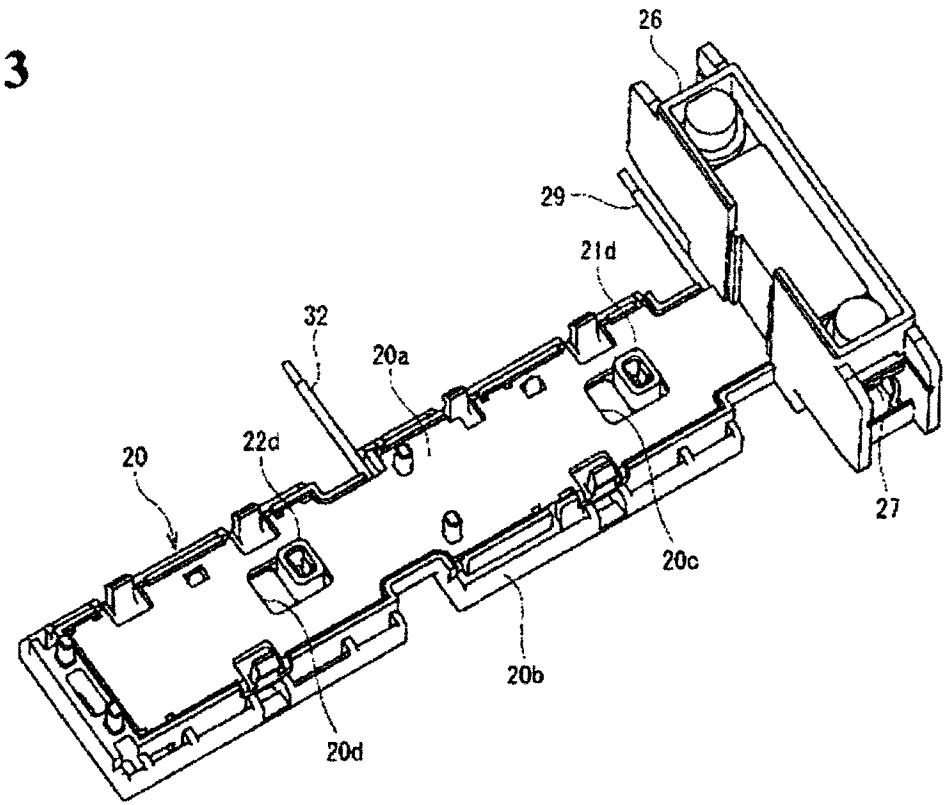
FIG. 3 shows the reversible unit in accordance with the present invention from the bottom plate side.
Figure 4:
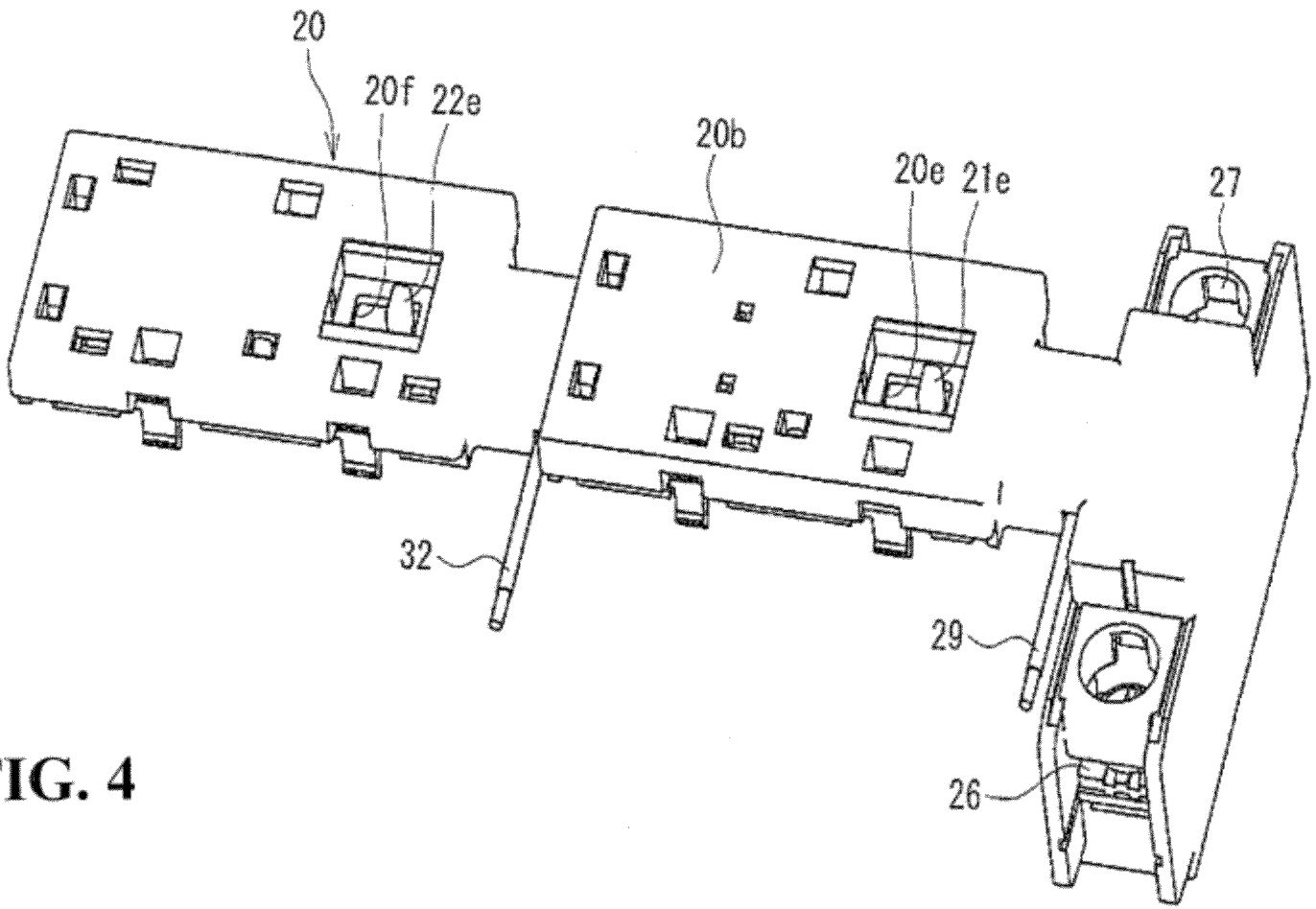
FIG. 4 shows the reversible unit in accordance with the present invention from the front surface side.

As shown in FIGS. 3 and 4, the reversible unit 20 has a rectangular bottom plate 20*a* that is connected to the arc-extinguishing covers 2*a*, 2*b* (see FIG. 1) when the reversible unit is mounted across the two electromagnetic contactors 1*a*, 1*b*, a unit frame 20*b* in the form of an open-lid box that is integrally mounted on the circumferential edge of the bottom plate 20*a*, and unit connection terminals 26, 27 integrally formed with one end of the unit frame 20*b* in the longitudinal direction.

As shown in FIG. 3, rectangular openings 20*c*, 20*d* are formed in the bottom plate 20*a* at positions set apart in the longitudinal direction. As shown in FIG. 4, a pair of display windows 20*e*, 20*f* opened in rectangular shape is formed at positions set apart in the longitudinal direction, these positions corresponding to the openings 20*c*, 20*d* of the bottom plate 20*a*.

As shown in FIG. 5, the first interlock plate 21 comprises a bent portion 21*b* formed by bending an elongated portion 21*a* in an L-like shape at one end thereof in the longitudinal direction, a pin engagement orifice 21*c* formed in the distal end of the bent portion 21*b*, a tubular connection bridge 21*d* formed to protrude at one surface at the other end side of the elongated portion 21*a* in the longitudinal direction, and a reversible unit operation indication piece 21*e* formed at the other surface at the other end side of the elongated portion 21*a*. The reversible unit operation indication piece 21*e* is not shown in FIG. 5 and is shown as a member positioned inside the first display window 20*e* in FIG. 7.

The second interlock plate 22 is a member of the same shape as the first interlock shape 21 and provided with a bent portion 22*b* formed by bending an elongated portion 22*a* in an L-like shape at one end thereof in the longitudinal direction, a pin engagement orifice 22*c* formed in the distal end of the bent portion 22*b*, a tubular connection bridge 22*d* formed to protrude at one surface at the other end side of the elongated portion 22*a* in the longitudinal direction, and a reversible unit operation indication piece 22*e* formed at the other surface at the other end side of the elongated portion 22*a*. The reversible unit operation indication piece 22*e* is not shown in FIG. 5 and is shown as a member positioned inside the first display window 20*f* in FIG. 7.

Figure 6:
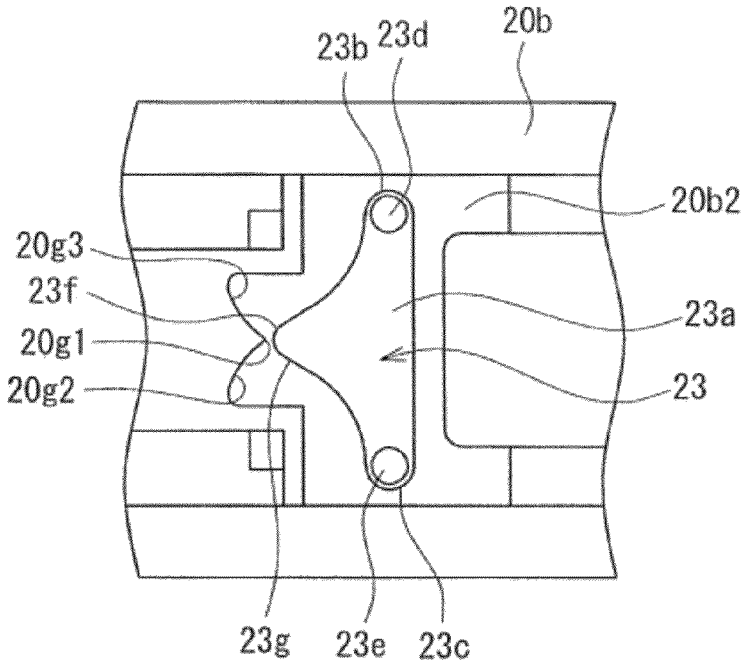
FIGS. 6(*a*) and 6(*b*) show the mechanism of mechanical interlock inside the reversible unit in accordance with the present invention.
Figure 6:
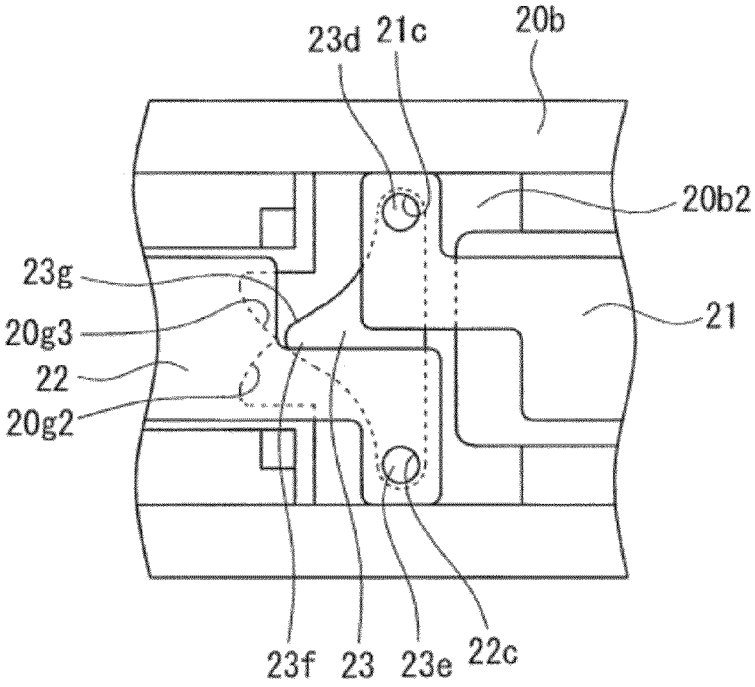

As shown in FIG. 6(*a*), the lock piece 23 is a member provided with a plate-shaped main body 23*a* of a substantially triangular shape in the plan view thereof and rotation pins 23*d*, 23*e* protruding in the same direction from the side surface close to a first apex 23*b* and a second apex 23*c* of the plate-shaped main body 23*a*. The lock piece is disposed in the accommodation recess 20*b*2 provided between the unit frame 20*b* and the bottom plate 20*a*, so that the first apex 23*b* and the second apex 23*c* are positioned in the short side direction of the unit frame 20*b*.

The inner wall of the accommodation recess 20*b*2 that is opposite a third apex 23*f* of the lock piece 23 is formed to protrude in a peak-like form toward the third apex 23*f* and has a shape such that a first tilted circumferential wall 20*g*2 and a second tilted circumferential wall 20*g*3 extend at a substantially the same tilt angle toward a circumferential wall apex 20*g*1. The circumferential surface in the thickness direction of the third apex 23*f* serves as a lock surface 23*g* that is engaged with the first tilted circumferential wall 20*g*2 and the second tilted circumferential wall 20*g*3.

Further, as shown in FIG. 6(*b*), the first interlock plate 21 and the second interlock plate 22 connected by the lock piece 23 are arranged in the longitudinal direction inside the unit frame 20*b* by pin joining the rotation pin 23*d* of the lock piece 23 disposed in the accommodation recess 20*b*2 and the pin engagement orifice 21*c* of the first interlock plate 21 and by pin joining the rotation pin 23*e* of the lock piece 23 and the pin engagement orifice 22*c* of the second interlock plate 22.

Figure 8:
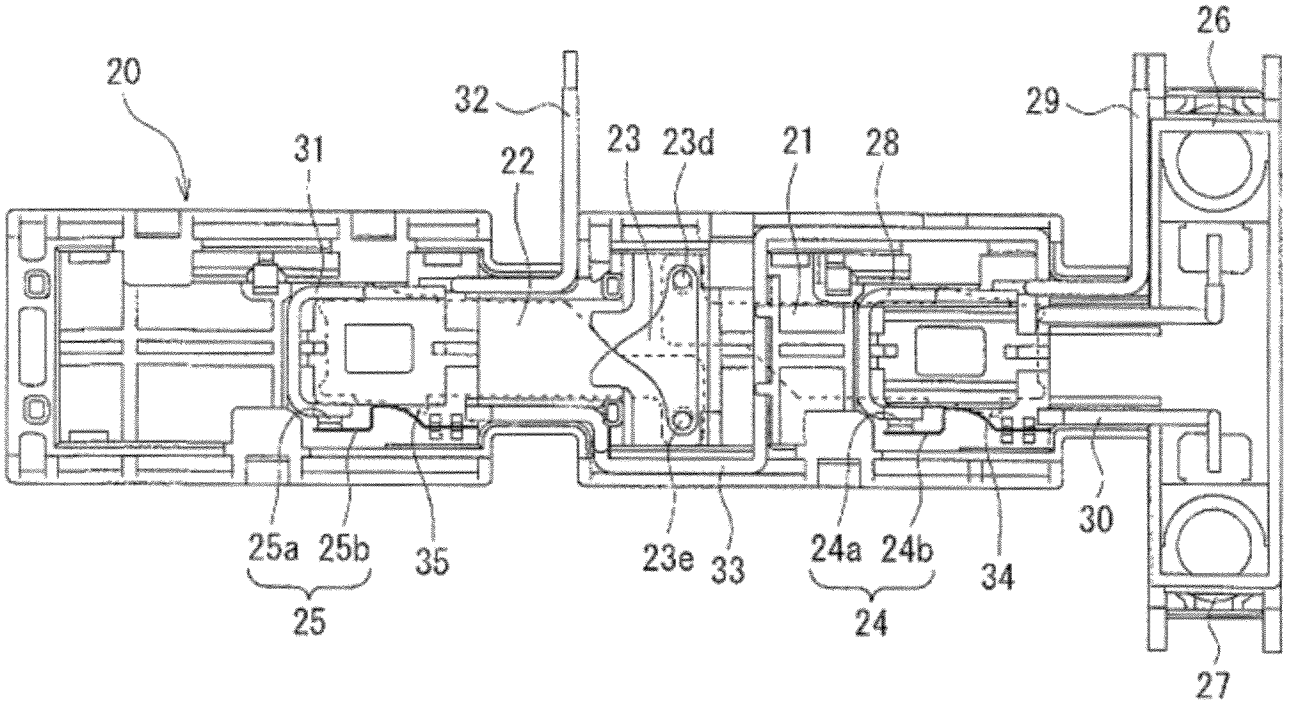
FIG. 8 illustrates the operation of the reversible unit when the two electromagnetic contactors are in the released state.

As shown in FIGS. 5 and 8, the first normally-closed contact 24 comprises a first fixed contact 24*a* and a first movable contact 24*b* constituted by a plate spring, the first fixed contact 24*a* is connected to a flexible first extending connection wire 29 protruding outward of the reversible unit 20 by an inner connection wire 28 extending around the moving direction of the first interlock plate 21, and the first movable contact 24*b* is connected to the unit connection terminal 27 by an inner connection wire 30.

The second normally-closed contact 25 comprises a second fixed contact 25*a* and a second movable contact 25*b* constituted by a plate spring, the second fixed contact 25*a* is connected to a flexible second extending connection wire 32 protruding outward of the reversible unit 20 by an inner connection wire 31 extending around the moving direction of the second interlock plate 22, and the movable contact 24*b* is connected to the unit connection terminal 26 by an inner connection wire 33 extending around the moving direction of the first interlock plate 21 and the second interlock plate 22.

In this case, as shown in FIGS. 5 and 8, a first opening operation engagement portion 34 of a protruding shape is formed in the first interlock plate 21. The first opening operation engagement portion 34 engages with the first movable contact 24*b* when the first interlock plate 21 moves in the closing operation direction, elastically deforms the first movable contact 24*b* in the direction of withdrawing from the first fixed contact 24*a*, and sets the first normally-closed contact 24 to the open state.

Further, a second opening operation engagement portion 35 of a protruding shape is also formed in the second interlock plate 22. The second opening operation engagement portion 35 engages with the second movable contact 25*b* when the second interlock plate 22 moves in the closing operation direction, elastically deforms the second movable contact 25*b* in the direction of withdrawing from the second fixed contact 25*a*, and sets the second normally-closed contact 25 to the open state.

Further, the reversible unit 20 is assembled by positioning the reversible unit operation indication pieces 21*e*, 22*e* of the first interlock plate 21 and the second interlock plate 22 inside the display windows 20*e*, 20*f* formed in the unit frame 20*b*, as shown in FIG. 4, passing the connection bridges 21*d*, 22*d* of the first interlock plate 21 and the second interlock plate 22 through the openings 20*c*, 20*d* formed in the bottom plate 20*a* and allowing the connection bridges to protrude outside, as shown in FIG. 3, and integrally mounting the bottom plate 20*a* and the circumferential edge of the unit frame 20*b*.

Figure 7:
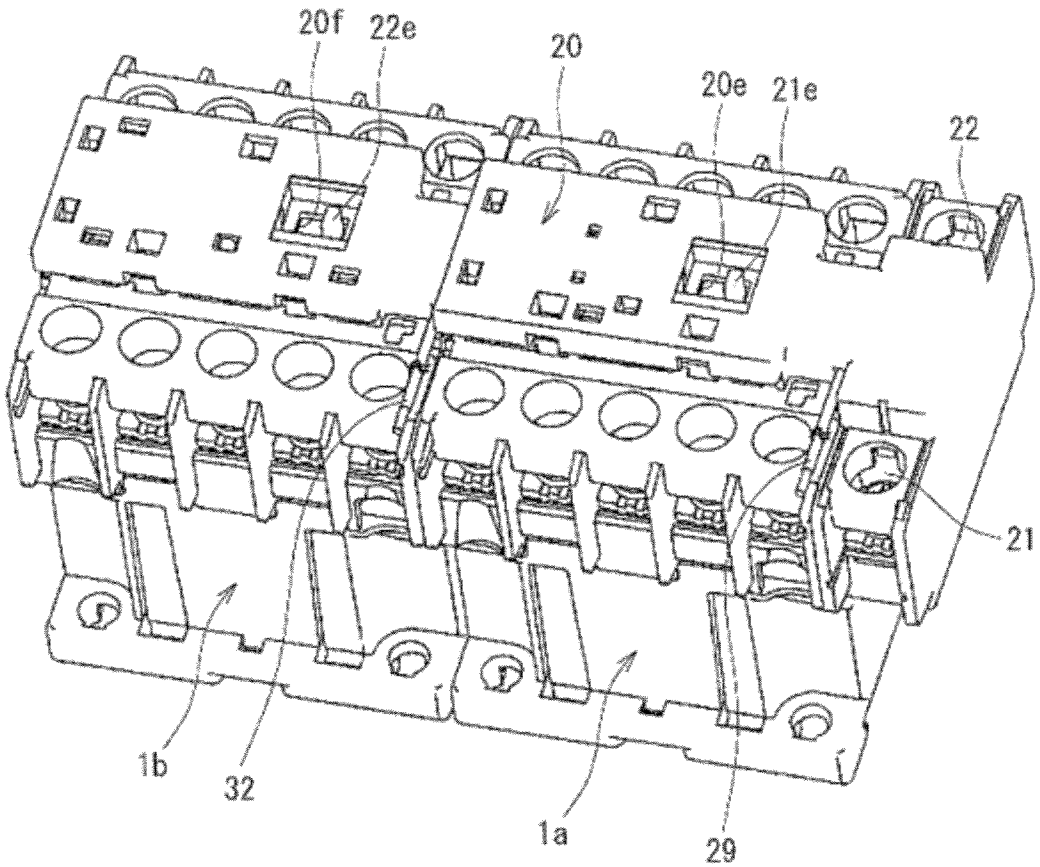
FIG. 7 shows a state in which the reversible unit is mounted to as to be laid across the upper surfaces of the two electromagnetic contactors constituting the present invention.

With the reversible unit 20 of the above-described configuration, where the connection bridges 21*d*, 22*d* of the first interlock plate 21 and the second interlock plate 22 protruding to the outside from the openings 20*c*, 20*d* of the bottom plate 20*a* are connected in the fitting state thereof to the respective head portions of the operation indication pieces 4*a*, 4*b* (see FIG. 1) of the two adjacently disposed electromagnetic contactors 1*a*, 1*b*, a reversible electromagnetic contactor is configured in which, as shown in FIG. 7, the reversible unit 20 is mounted across the upper surface of the electromagnetic contactors 1*a*, 1*b*.

One electromagnetic contactor in accordance with the present invention corresponds to one of the reverse-rotation electromagnetic contactor 1*a* and the direct-rotation electromagnetic contactor 1*b*, the other electromagnetic contactor in accordance with the present invention corresponds to the other of the reverse-rotation electromagnetic contactor 1*a* and the direct-rotation electromagnetic contactor 1*b*, the exciting coils in accordance with the present invention correspond to coils 6*a*, 6*b*, and the unit case in accordance with the present invention corresponds to the bottom plate 20*a*, the unit case in accordance with the present invention corresponds to the unit frame 20*b*, and the interlock plates in accordance with the present invention correspond to the first interlock plate 21 and the second interlock plate 22.

The control circuit of an induction motor 37 provided with the reversible electromagnetic contactor is connected as shown in FIG. 2.

Thus, the power-supply-side main circuit terminals 7*a* and the load-side main circuit terminals 7*b* of the two electromagnetic contactors 1*a*, 1*b* are connected in parallel, the main circuit power source (R, S, T) is connected to the power-supply-side main circuit terminals 7*a*, the induction motor 37 is connected by a thermal relay 36 to the load-side main circuit terminals 7*b*, and the coil terminals 9*b*, 9*b* of the two electromagnetic contactors 1*a*, 1*b* are connected together.

A control button 38 provided with a direct-rotation, reverse-rotation, and stop push-buttons is connected to the auxiliary contact terminals 8*a*, 8*b* of the two electromagnetic contactors 1*a*, 1*b*, one electromagnetic contactor 1*a* is taken as a direct-rotation electromagnetic contactor and the other electromagnetic contactor 1*b* is taken as a reverse-rotation electromagnetic contactor (referred to hereinbelow as direct-rotation electromagnetic contactor 1*b* and reverse-rotation electromagnetic contactor 1*a*).

Further, the first extending connection wire 29 connected to the first normally-closed contact 24 incorporated in the reversible unit 20 is connected to the coil terminal 9*a* of the direct-rotation electromagnetic contactor 1*b*, and the unit connection terminal 27 connected to the first normally-closed contact 24 is connected to the auxiliary contact terminal 8*b* of the direct-rotation electromagnetic contactor 1*b*.

Further, the second extending connection wire 32 connected to the second normally-closed contact 25 incorporated in the reversible unit 20 is connected to the coil terminal 9*a* of the reverse-rotation electromagnetic contactor 1*a*, and the unit connection terminal 26 connected to the second normally-closed contact 25 is connected to the auxiliary contact terminal 8*b* of the reverse-rotation electromagnetic contactor 1*a*.

Figure 9:
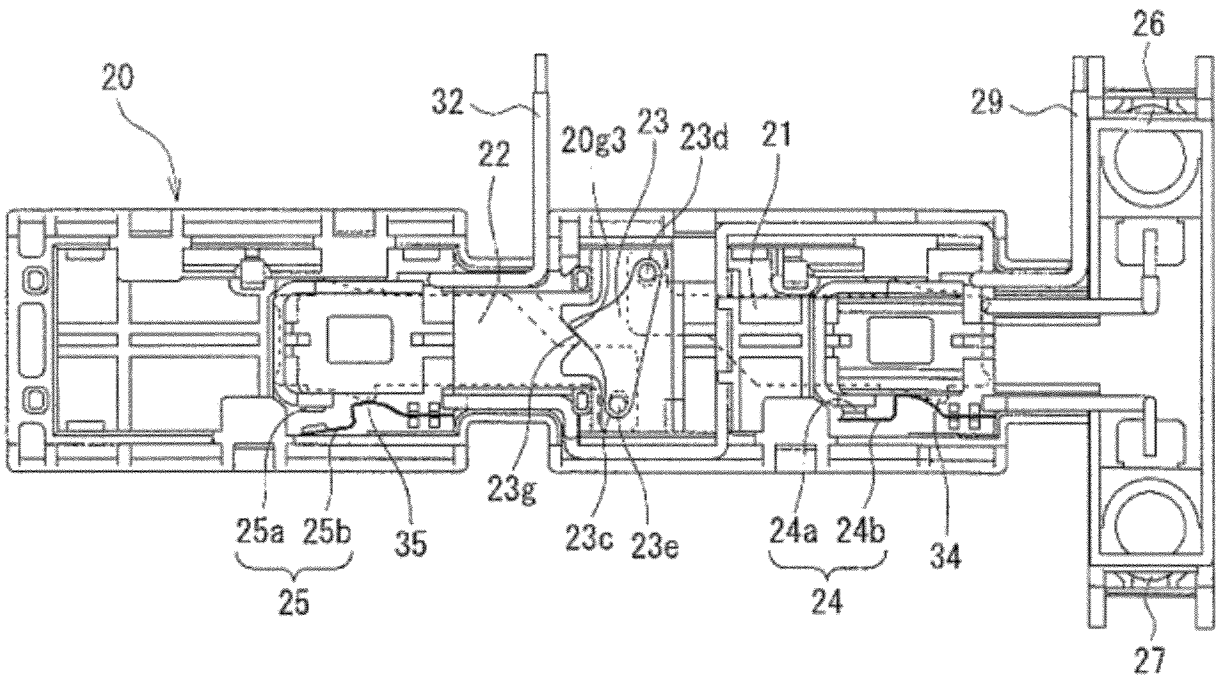
FIG. 9 illustrates the operation of the reversible unit when one of the two electromagnetic contactors is in the closed state.
Figure 10:
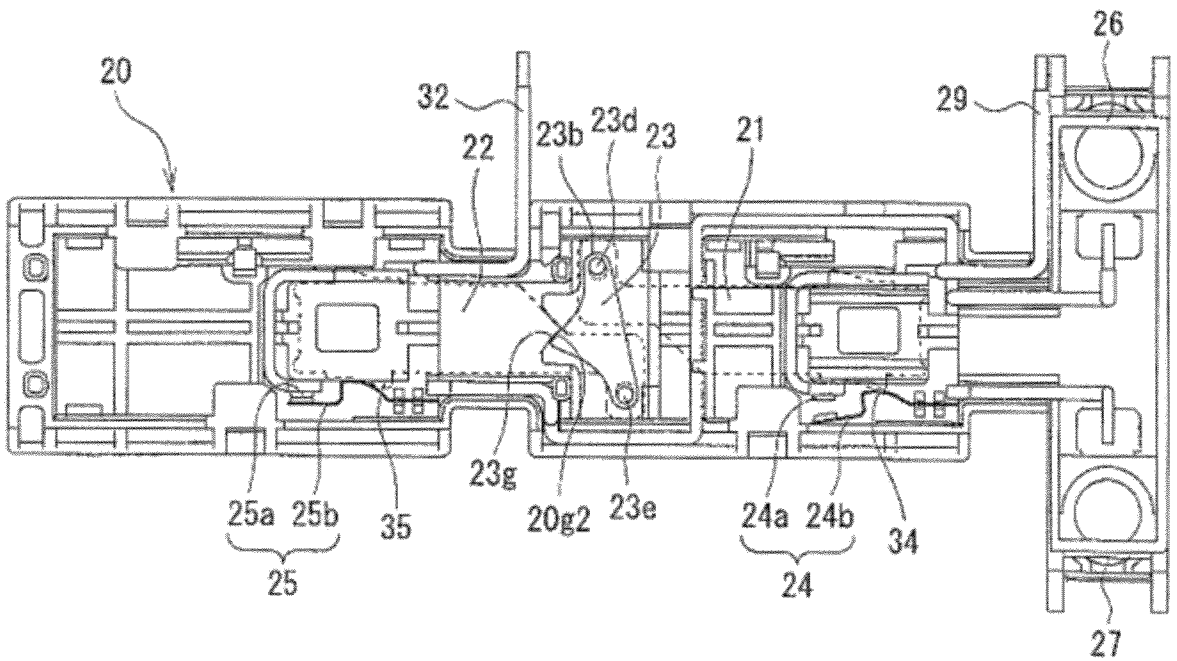
FIG. 10 illustrates the operation of the reversible unit when the other of the two electromagnetic contactors is in the closed state.
Figure 11:
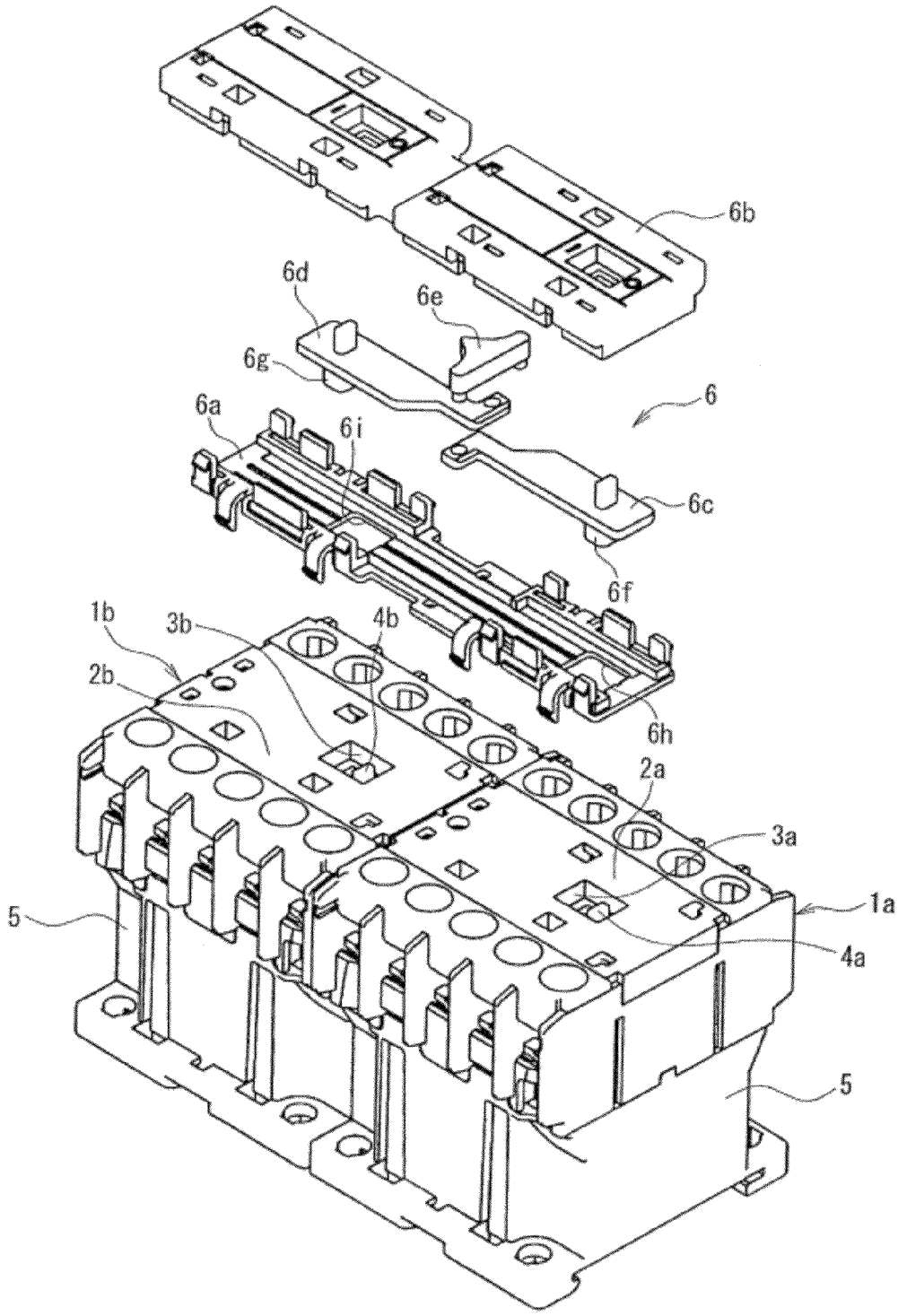
FIG. 11 Prior Art
FIG. 11 shows the devices constituting the conventional reversible electromagnetic contactor.

FIG. 9 illustrates the operation of the reversible unit 20 performed when the direct-rotation push-button of the control button 38 is pushed and the direct-rotation electromagnetic contactor 1*b* is closed. FIG. 10 illustrates the operation of the reversible unit 20 performed when the reverse-rotation push-button of the control button 38 is pushed and the reverse-rotation electromagnetic contactor 1*a* is closed.

First, the operation of the reversible unit 20 performed when the direct-rotation electromagnetic contactor 1*b* is in the closed state will be explained.

With the direct-rotation electromagnetic contactor 1*b* in the closed state, the movable contact support 4 is moved in the closing operation direction by energizing the coil 6*b*, and the operation indicating piece 4*b*, which is integrated with the movable contact support 4, moves from the right side to the left side of the display window 3*b*. Therefore, the second interlock plate 22 of the reversible unit 20 that is connected to the operation indication piece 4*b* by the connection bridge 22*d* moves in the closing operation direction shown by a broken line in FIG. 9. With the reverse-rotation electromagnetic contactor 1*a* in the released state, the operation display piece 4*a* is positioned at the right side of the display window 3*a* and therefore, the first interlock plate 21 of the reversible unit 20 that is connected to the operation indication piece 4*a* by the connection bridge 21*d* does not move.

In this case, the second apex 23*c* side of the lock piece 23 of the reversible unit 20 rotates together with the second interlock plate 22 in the closing operation direction about the rotation pin 23*d* engaged with the pin engagement orifice 21*c* of the first interlock plate 21, and the lock surface 23*g* abuts on the second tilted circumferential wall 20*g*3.

Since the rotation pin 23*d* side of the lock piece 23 is prevented from rotating to the closing operation direction because of the abutment of the lock surface 23*g* on the second tilted circumferential wall 20*g*3, the first interlock plate 21 cannot move together with the second interlock plate 22 in the closing operation direction.

Further, when the second interlock plate 22 of the reversible unit 20 moves in the closing operation direction, the second opening operation engagement portion 35 formed at the second interlock plate 22 elastically deforms the second movable contact 25*b* of the second normally-closed contact 25 and withdraws the second movable contact from the second fixed contact 25*a*. As a result, the second normally-closed contact 25 assumes the open state. When the second normally-closed contact 25 is in the open state, an exciting circuit to the coil 6*a* of the reverse-rotation electromagnetic contactor 1*a* is in a cut-off state.

The operation of the reversible unit 20 performed when the reverse-rotation electromagnetic contactor 1*a* is in the closed state will be explained below.

With the reverse-rotation electromagnetic contactor 1*a* in the closed state, the movable contact support 4 is moved in the closing operation direction by energizing the coil 6*a*, and the operation indicating piece 4*a*, which is integrated with the movable contact support 4, moves from the right side to the left side of the display window 3*a*. Therefore, the first interlock plate 21 of the reversible unit 20 that is connected to the operation indication piece 4*a* by the connection bridge 21*d* moves in the closing operation direction shown by a broken line in FIG. 10. With the direct-rotation electromagnetic contactor 1*b* in the released state, the operation display piece 4*b* is positioned at the right side of the display window 3*b* and therefore, the second interlock plate 22 of the reversible unit 20 that is connected to the operation indication piece 4*b* by the connection bridge 22*d* does not move.

In this case, the first apex 23*b* side of the lock piece 23 of the reversible unit 20 rotates together with the first interlock plate 21 in the closing operation direction about the rotation pin 23*e* engaged with the pin engagement orifice 22*c* of the second interlock plate 22, and the lock surface 23*g* abuts on the first tilted circumferential wall 20*g*2.

Since the rotation pin 23*e* side of the lock piece 23 is prevented from rotating to the closing operation direction because of the abutment of the lock surface 23*g* on the first tilted circumferential wall 20*g*3, the first interlock plate 21 cannot move together with the second interlock plate 22 in the closing operation direction.

Further, when the first interlock plate 21 of the reversible unit 20 moves in the closing operation direction, the first opening operation engagement portion 34 formed at the first interlock plate 21 elastically deforms the first movable contact 24*b* of the first normally-closed contact 24 and withdraws the first movable contact from the first fixed contact 24*a*. As a result, the first normally-closed contact 24 is in the open state. When the first normally-closed contact 24 is in the open state, the exciting circuit to the coil 6*b* of the direct-rotation electromagnetic contactor 1*b* is in a cut-off state.

The effects of the reversible electromagnetic contactor provided with the reversible unit 20 of the above-described configuration will be explained below.

When the direct-rotation electromagnetic contactor 1*b* is in the closed state and the second interlock plate 22 of the reversible unit 20 moves in the closing operation direction, the lock piece 23 restricts the movement of the first interlock plate 21 in the closing operation direction and maintains the released state of the reverse-rotation electromagnetic contactor 1*a*, and mechanical interlock is performed such as to prevent the two electromagnetic contactors 1*a*, 1*b* from being closed at the same time. Further, in the second interlock plate 22 of the reversible unit 20, the second opening operation engagement portion 35 that has moved in the closing operation direction sets the second normally-closed contact 25 to the open state and the exciting circuit to the coil 6*a* of the reverse-rotation electromagnetic contactor 1*a* is cut off. Therefore, electrical interlock is performed such as to prevent the two electromagnetic contactors 1*a*, 1*b* from being closed at the same time.

Conversely, when the reverse-rotation electromagnetic contactor 1*a* is in the closed state and the first interlock plate 21 of the reversible unit 20 moves in the closing operation direction, the lock piece 23 restricts the movement of the second interlock plate 22 in the closing operation direction and maintains the released state of the direct-rotation electromagnetic contactor 1*b*, and mechanical interlock is performed such as to prevent the two electromagnetic contactors 1*a*, 1*b* from being closed at the same time. Further, in the first interlock plate 21 of the reversible unit 20, the first opening operation engagement portion 34 that has moved in the closing operation direction sets the first normally-closed contact 24 to the open state and the exciting circuit to the coil 6*b* of the direct-rotation electromagnetic contactor 1*b* is cut off. Therefore, electrical interlock is performed such as to prevent the two electromagnetic contactors 1*a*, 1*b* from being closed at the same time.

Thus, with the reversible electromagnetic contact provided with the reversible unit 20 according to the present embodiment, mechanical and electrical interlock can be performed such as to prevent the two electromagnetic contactors 1*a*, 1*b* from being closed at the same time.

The normally-closed contacts (contacts (b)) are necessary to ensure the electrical interlock, but in the present embodiment the first normally closed contact 24 and the second normally closed contact 25 are provided inside the reversible unit 20. Therefore, it is not necessary to connect auxiliary contact units for adding the normally-closed contacts (contacts (b)) to the auxiliary contacts 10 of the normally-open contacts (contacts (a)) incorporated by one pole thereof in the two electromagnetic contactors 1*a*, 1*b*. Since the auxiliary contact units are thus not connected, the external dimensions of the device are not increased and expenses on the auxiliary contact unit are unnecessary. Therefore, the device can be reduced in size and cost.

The first normally-closed contact 24 incorporated in the reversible unit 20 is configured to be open when the first opening operation engagement portion 34 provided at the first interlock plate 21 moving in the closing operation direction elastically deforms the first movable contact 24*b* constituted by a plate spring and withdraws the first movable contact from the first fixed contact 24*a*. The second normally-closed contact 25 is also configured to be open when the second opening operation engagement portion 35 provided at the second interlock plate 22 moving in the closing operation direction elastically deforms the second movable contact 25*b* constituted by a plate spring and withdraws the second movable contact from the fifth fixed contact 24*a*. Because of a simple structure in which the first normally closed contact 24 or the second normally-closed contact 25 is in an open state when the first opening operation engagement portion 34 engages with the first interlock plate 21 moving in the closing operation direction or the second opening operation engagement portion 35 engages with the second interlock plate 22 moving in the closing operation direction, the production cost of the reversible unit 20 can be reduced.

Industrial Applicability

As described hereinabove, the reversible electromagnetic contactor in accordance with the present invention is suitable for connecting other additional circuits, without using auxiliary contacts incorporated in the electromagnetic contactor, when performing mechanical and electrical interlock to prevent two electromagnetic contactors from being closed at the same time, and also enables size reduction and cost reduction.

EXPLANATION OF REFERENCE NUMERALS

1*a* . . . reverse-rotation electromagnetic contactor; 1*b* . . . direct-rotation electromagnetic contactor; 2*a*, 2*b* . . . arc-extinguishing covers; 3*a*, 3*b* . . . display windows, 4*a*, 4*h* . . . operation indicating pieces; 5 . . . case; 6*a*, 6*b* . . . coils; 7*a* . . . power-supply-side main circuit terminal; 7*b* . . . load-side main circuit terminal; 8*a*, 8*b* . . . auxiliary contact terminals; 9*a*, 9*b* . . . coil terminals; 10 . . . auxiliary contact; 20 . . . reversible unit; 20*a* . . . bottom plate; 20*b* . . . unit frame; 20*b*2 . . . accommodation recess; 20*c*, 20*d* . . . openings; 20*e*, 20*f* . . . display windows; 20*g* . . . circumferential wall apex; 20*g*2 . . . first tilted circumferential wall; 20*g*3 . . . second tilted circumferential wall; 21 . . . first interlock plate; 21*a* . . . elongated portion; 21*b* . . . bent portion; 21*c* . . . pin engagement orifice; 21*d* . . . connection bridge; 21*e* . . . reversible unit operation indication piece; 22 . . . second interlock plate; 22*a* . . . elongated portion; 22*b* . . . bent portion; 22*c* . . . pin engagement orifice; 22*d* . . . connection bridge;

22*e* . . . reversible unit operation indication piece; 23 . . . lock piece; 23*a* . . . plate-shaped main body; 23*b* . . . first apex; 23*c* . . . second apex; 23*d*, 23*e* . . . rotation pins; 23*f* . . . third apex; 23*g* . . . lock surface; 24 . . . first normally-closed contact; 24*a* . . . first fixed contact; 24*b* . . . first movable contact; 25 . . . second normally-closed contact; 25*a* . . . second fixed contact; 25*b* . . . second movable contact; 26, 27 . . . unit connection terminals; 28, 30, 31, 33 . . . inner connection wire; 29 . . . first extending connection wire; 32 . . . second extending connection wire; 34 . . . first opening operation engagement portion; 35 . . . second opening operation engagement portion; 36 . . . thermal relay; 37 . . . induction motor; 38 . . . control button

What is claimed is:

1. A reversible electromagnetic contactor in which a pair of electromagnetic contactors is disposed adjacently to move respective operation indication pieces protruding on upper surfaces in a same direction in a closing operation and a reversible unit is mounted across the upper surfaces of the pair of electromagnetic contactors, wherein the reversible unit comprises a pair of interlock plates detachably connected to the respective operation indication pieces of the pair of electromagnetic contactors and moving in a same direction as a moving direction of the operation indication pieces, a lock piece connecting with the pair of interlock plates, a first normally-closed contact, a second normally-closed contact, and a unit case accommodating the pair of interlock plates, the lock piece, and the first and second normally-closed contacts, and mounted across the upper surfaces of the pair of electromagnetic contactors, wherein in a closing operation of one of the electromagnetic contactors, the lock piece rotates in a first direction together with a movement of one of the interlock plates to prevent the other of the interlock plates from moving, and to maintain a release operation of the other of the electromagnetic contactors, and in a closing operation of the other of the electromagnetic contactors, the lock piece rotates in a second direction, different from the first direction, together with a movement of the other of the interlock plates to prevent the one of the interlock plates from moving, and to maintain a release operation of the one of the electromagnetic contactors, wherein the first normally-closed contact is connected in series in a power supply circuit to an exciting coil of the other of the electromagnetic contactors, and the one of the interlock plates includes a first opening operation engagement portion performing a release operation of the first normally-closed contact when the one of the interlock plates moves, and the second normally-closed contact is connected in series in a power supply circuit to an exciting coil of the one of the electromagnetic contactors, and the other of the interlock plates includes a second opening operation engagement portion performing a release operation of the second normally-closed contact when the other of the interlock plates moves, and wherein the first normally-closed contact comprises a first fixed contact and a first movable contact having a spring member, and is disposed along a moving direction of the one of the interlock plates; and when the one of the interlock plates moves, the first opening operation engagement portion moving toward the first normally-closed contact elastically deforms the first movable contact in a direction withdrawing from the first fixed contact to establish an open state.

2. A reversible electromagnetic contactor according to claim 1, wherein the first opening operation engagement portion is a protrusion engageable with the first movable contact and formed integrally with the one of the interlock plates positioned at the first normally-closed contact side.

3. A reversible electromagnetic contactor in which a pair of electromagnetic contactors is disposed adjacently to move respective operation indication pieces protruding on upper surfaces in a same direction in a closing operation and a reversible unit is mounted across the upper surfaces of the pair of electromagnetic contactors, wherein the reversible unit comprises a pair of interlock plates detachably connected to the respective operation indication pieces of the pair of electromagnetic contactors and moving in a same direction as a moving direction of the operation indication pieces, a lock piece connecting with the pair of interlock plates, a first normally-closed contact, a second normally-closed contact, and a unit case accommodating the pair of interlock plates, the lock piece, and the first and second normally-closed contacts, and mounted across the upper surfaces of the pair of electromagnetic contactors, wherein in a closing operation of one of the electromagnetic contactors, the lock piece rotates in a first direction together with a movement of one of the interlock plates to prevent the other of the interlock plates from moving, and to maintain a release operation of the other of the electromagnetic contactors, and in a closing operation of the other of the electromagnetic contactors, the lock piece rotates in a second direction, different from the first direction, together with a movement of the other of the interlock plates to prevent the one of the interlock plates from moving, and to maintain a release operation of the one of the electromagnetic contactors, wherein the first normally-closed contact is connected in series in a power supply circuit to an exciting coil of the other of the electromagnetic contactors, and the one of the interlock plates includes a first opening operation engagement portion performing a release operation of the first normally-closed contact when the one of the interlock plates moves, and the second normally-closed contact is connected in series in a power supply circuit to an exciting coil of the one of the electromagnetic contactors, and the other of the interlock plates includes a second opening operation engagement portion performing a release operation of the second normally-closed contact when the other of the interlock plates moves, and wherein the second normally-closed contact comprises a second fixed contact and a second movable contact having a spring member, and is disposed along a moving direction of the other of the interlock plates, and when the other of the interlock plates moves, the second opening operation engagement portion moving toward the second normally-closed contact elastically deforms the second movable contact in a direction withdrawing from the first fixed contact to establish an open state.

4. A reversible electromagnetic contactor according to claim 3, wherein the second opening operation engagement portion is a protrusion engageable with the second movable contact and formed integrally with the other of the interlock plates positioned at the second normally-closed contact side.

5. A reversible electromagnetic contactor in which a pair of electromagnetic contactors is disposed adjacently to move respective operation indication pieces protruding on upper surfaces in a same direction in a closing operation and a reversible unit is mounted across the upper surfaces of the pair of electromagnetic contactors, wherein the reversible unit comprises a pair of interlock plates detachably connected to the respective operation indication pieces of the pair of electromagnetic contactors and moving in a same direction as a moving direction of the operation indication pieces, a lock piece connecting with the pair of interlock plates, a first normally-closed contact, a second normally-closed contact, and a unit case accommodating the pair of interlock plates, the lock piece, and the first and second normally-closed contacts, and mounted across the upper surfaces of the pair of electromagnetic contactors, wherein in a closing operation of one of the electromagnetic contactors, the lock piece rotates in a first direction together with a movement of one of the interlock plates to prevent the other of the interlock plates from moving, and to maintain a release operation of the other of the electromagnetic contactors, and in a closing operation of the other of the electromagnetic contactors, the lock piece rotates in a second direction, different from the first direction, together with a movement of the other of the interlock plates to prevent the one of the interlock plates from moving, and to maintain a release operation of the one of the electromagnetic contactors, wherein the first normally-closed contact is connected in series in a power supply circuit to an exciting coil of the other of the electromagnetic contactors, and the one of the interlock plates includes a first opening operation engagement portion performing a release operation of the first normally-closed contact when the one of the interlock plates moves, and the second normally-closed contact is connected in series in a power supply circuit to an exciting coil of the one of the electromagnetic contactors, and the other of the interlock plates includes a second opening operation engagement portion performing a release operation of the second normally-closed contact when the other of the interlock plates moves, and wherein the reversible unit includes unit connection terminals connected to the first normally-closed contact and the second-normally closed contact at an end portion thereof.

* * * * *

UNITED STATES PATENT AND TRADEMARK OFFICE

CERTIFICATE OF CORRECTION

PATENT NO. : 8,536,961 B2
APPLICATION NO. : 13/508242
DATED : September 17, 2013
INVENTOR(S) : Kouetsu Takaya et al.

It is certified that error appears in the above-identified patent and that said Letters Patent is hereby corrected as shown below:

In the Claims:

Change column 12, line 50, "display windows, 4a, 4h…" to --display windows, 4a, 4b…--.

Change column 12, line 57, "display windows; 20g…" to --display windows; 20g1…--.

Signed and Sealed this
Eleventh Day of February, 2014

Michelle K. Lee

Michelle K. Lee
*Deputy Director of the United States Patent and Trademark Office*